United States Patent [19]

Parrish

[11] Patent Number: 4,876,755

[45] Date of Patent: Oct. 31, 1989

[54] TOTAL BACK SUPPORT SYSTEM

[76] Inventor: Deborah Parrish, 12 Glenn Ter., Vineland, N.J. 08360

[21] Appl. No.: 236,233

[22] Filed: Aug. 25, 1988

[51] Int. Cl.[4] ..... A47C 20/08

[52] U.S. Cl. ..... 5/431; 5/432; 5/437; 5/465; 297/284

[58] Field of Search ..... 5/432, 431, 434, 436, 5/437, 465; 297/284, 118, DIG. 6, 460

[56] References Cited

U.S. PATENT DOCUMENTS

| | | | |
|---|---|---|---|
| D. 251,985 | 5/1979 | Martin | 5/431 X |
| 1,549,601 | 8/1925 | Mulgrew | 5/431 X |
| 3,299,451 | 1/1967 | Trogdon | 5/337 |
| 3,968,529 | 7/1976 | Levin et al. | 5/338 |
| 4,017,118 | 4/1977 | Cawley | 297/284 |
| 4,097,087 | 6/1978 | Garavaglia | 297/284 |
| 4,394,783 | 7/1983 | Simmons | 5/437 X |
| 4,506,396 | 3/1985 | Ritchie, Jr. et al. | 5/431 |
| 4,777,678 | 10/1988 | Moore | 5/465 X |
| 4,794,657 | 1/1989 | Avery | 5/437 X |

*Primary Examiner*—Gary L. Smith
*Assistant Examiner*—Michael J. Milano
*Attorney, Agent, or Firm*—Thomas A. Lennox

[57] ABSTRACT

A total back support cushion device including two or three cushion devices of a semi-cylindrical shape, having been cut lengthwise through a central axis of a cylinder, with Velcro strips positioned to allow the cushions to be fastened together to form a cylindrical shape, a "T" shape for lumbar and thoracic support or cervical and thoracic support or a side lying "H" shape for support of the lumbar, thoracic and cervical regions of the back at the same time, the device being attached to a chair back for support when the person is sitting upright or the individual semi-cylindrical cushions detached and placed under the cervical or lumbar regions of the back while the person is reclining.

22 Claims, 3 Drawing Sheets

TOTAL BACK SUPPORT SYSTEM

BACKGROUND OF THE INVENTION

This invention involves a total back support cushion system and more particularly involves a device and method which supports the thoracic, lumbar, and cervical regions of the spine all at one time or in various combinations.

It is long been recognized that it is desireable to support the entire person's back when seated or lying down. Most seats and many beds are totally or inadequately designed to support the person's back over a period of time. Bolster pillows and cylindrical and semicylindrical lumbar and cervical support cushions have been available for some time. Some devices are directed to support of the head and the lumbar portion of the back.

However, persons suffering from low back pain, a muscle injury due to whiplash or a more serious back condition find that support of a particular area of the back is insufficient. Some tend to exacerbate a condition in another portion of the back. A system has been needed for total back support. None of the devices described above or those available in the art satisfy these needs nor attain the objects described herein below.

SUMMARY OF THE INVENTION

It is an object of the present invention to provide a total back support device which provides support for the thoracic, lumbar and cervical sections of the back, singularly or in any multiple combination.

It is a specific object of the present invention to provide a total back support cushion system that is effective when the person in seating upright or in a slightly reclined position.

It is an additional object of the present invention to provide a total back support cushion system which is effective to support portions of the back in various combinations when the person is reclining.

It is a specific object of the present invention to provide a total back support cushion system which may be effectively used whether the person is sitting upright or in a supine position.

It is a specific object of the present invention to provide support for the thoracic section of the spine in combination with effective lumbar support and/or cervical back support.

It is a specific object of the present invention to provide a horizontal cushion section support that fits in the small of the back to support the lumbar area attached in its central location to a vertical section, to form a "T" shape which extends up the spine to support the thoracic area of the back giving a gentle pressure between the shoulder blades to encourage the user to relax into the support device and to allow the user to hold the neck and the head in a comfortable and upright and anatomically correct position.

It is a specific object of the present invention to provide a back support cushion device that relieves a person with over strained back and neck muscles, such as a result of whiplash, and to provide relief from forward head and rounded back posture that results from extended desk work, driving, lifting, injury and the like.

It is a specific object of the invention to provide a cushion system device which is in the general form of "H" shape used by positioning the "H" shape on its side with one leg positioned to give support to the lumbar region, the upright cross member giving gentle pressure to the thoracic region and the top horizontal leg being positioned to provide support in the cervical region of the back.

It is a specific object of the invention that the support cushion devices be detachable from either the "T" shape or the "H" shape to be used separately to support various areas of the back or to be attached to form a larger, thicker support cushion to be used in a specific region of the back.

It is an additional object of the present invention to provide a plurality of cushions with differing densities, firmness and support so as to provide increased support for a certain region of the back, such as the lumbar area.

It is additional object of the present invention to provide cushions in various lengths to take into account the difference in overall spinal length of persons of varying heights so that the lumbar and cervical support cushion is in the correct anatomical location when placed at ends of the thoracic support cushion.

It is an additional object of the present invention to provide cushion devices with covers wherein the resilient cushions may be removed and the covers cleaned after use.

It is a further object of the present invention to provide detachable connection devices for fastening the support cushions of the present invention in various configurations and that these attachments be located and chosen to avoid any discomfort by user contact.

It is an additional object of the present invention to avoid supporting one region of the spine and neglecting the rest of the spine by providing a support device tends to balance the support of adjacent regions of the spine.

The invention is a back support device including at least two cushion devices wherein each cushion device includes a semicylindrical resilient cushion, the halving being through a lengthwise central axis of a cylinder, the cushion including a flat rectangular surface, a semicylindrical surface, and two semicircular end surfaces. The device further includes at least two hook or loop fabric fastening means attached on surfaces of the cushion device, each fastening means to detachably fasten to a complimentary hook or loop fabric fastening means on a surface of another cushion device. The device further includes a first cushion device that includes a first hook or loop fabric fastening means positioned on the rectangular surface and a second hook or loop fabric fastening means on an end surface. The device further includes a second cushion device that includes a first hook or loop fabric fastening means positioned on the rectangular surface and a second hook or loop fabric fastening means on the semicylindrical surface positioned intermediate the length of the semicylindrical surface and proximate a lengthwise edge. The first hook or loop fabric fastening means on the first and second cushion devices are positioned to fasten together to form a cylindrical shaped support device, and the second hook or loop fabric fastening means on the first and second cushions are positioned to fasten together to form a "T" shaped support device with the two rectangular surfaces facing in a same direction.

It is preferred that the support device further includes a third cushion device including a hook or loop fabric fastening means positioned on the semicylindrical surface positioned intermediate the length and proximate a lengthwise edge, and wherein the first cushion device further includes a third hook or loop fabric fastening means positioned on the end surface opposite the second hook or loop fabric fastening means, the third hook or loop fabric fastening means being positioned to fasten to the hook or loop fabric fastening means on the third cushion device to form an "H" shaped support device from the three cushion devices fastened together with the rectangular surfaces of all three cushion devices facing a same direction. It is also preferred that the first hook or loop fabric fastening means be positioned transverse along both ends of the both rectangular surfaces. It is also preferred that the the second hook or loop fabric fastening means on the first cushion device includes a multiplicity of fiber hooks, and more preferred that both hook or loop fabric fastening means on the first cushion device include a multiplicity of fiber hooks. It is also preferred that the second hook or loop fabric fastening means on the second cushion device includes a multiplicity of fiber loops, and more preferred that both hook or loop fabric fastening means on the second cushion device include a multiplicity of fiber loops. It is also preferred that the hook or loop fabric fastening means on the third cushion device includes a multiplicity of fiber loops. It is preferred that each cushion device includes a resilient polymeric foam core and a cloth covering, and that each cushion device further includes an interfacing means enveloping the foam core inside the cloth covering to facilitate shifting of the core inside the covering. It is particularly preferred that the second cushion device includes a foam core firmer than that of the first cushion device It is also preferred that each cushion device includes a zipper closure of the cloth covering positioned on the rectangular surface, the zipper closure being of sufficient size to allow insertion and removal of the foam core It is also preferred that the support device further include a fabric loop attached and extending from an end surface of the second cushion device.

The invention is also a back support device including a first semicylindrical cushion device including a resilient cushion, the halving of the cushion being through a lengthwise central axis of a cylindrical cushion. The cushion has a flat rectangular surface, a semicylindrical surface, and two semicircular end surfaces, and at least two hook or loop fabric fastening means attached on surfaces of the first cushion device, each fastening means to detachably fasten to a complimentary hook or loop fabric fastening means on a surface of a second cushion device. The fastening means include a first hook or loop fabric fastening means positioned on the rectangular surface and a second hook or loop fabric fastening means on an end surface. The device further includes a second semicylindrical cushion device including a resilient cushion, the halving of the cushion being through a lengthwise central axis of a cylindrical cushion, the cushion having a flat rectangular surface, a semicylindrical surface, and two semicircular end surfaces. The second cushion device further includes at least two hook or loop fabric fastening means attached on surfaces of the second cushion device, each fastening means to detachably fasten to a complimentary hook or loop fabric fastening means on a surface of the first cushion device. The fastening means include a first hook or loop fabric fastening means positioned on the rectangular surface and a second hook or loop fabric fastening means on the semicylindrical surface positioned intermediate the length of the semicylindrical surface and proximate a lengthwise edge. The first hook or loop fabric fastening means on the first and second cushion devices are positioned to fasten together to form a cylindrical shaped support device, and the second hook or loop fabric fastening means on the first and second cushions are positioned to fasten together to form a "T" shaped support device with the two rectangular surfaces facing in a same direction.

The invention is also a back support device including a first semicylindrical cushion device including a resilient cushion, the halving of the cushion being through a lengthwise central axis of a cylindrical cushion, the cushion having a flat rectangular surface, a semicylindrical surface, and two semicircular end surfaces. The first cushion device includes at least three hook or loop fabric fastening means attached on surfaces of the first cushion device, each fastening means to detachably fasten to a complimentary hook or loop fabric fastening means on a surface of a second cushion device. The fastening means include a first hook or loop fabric fastening means positioned on the rectangular surface and a second and a third hook or loop fabric fastening means on each end surface. The support device further includes a second semicylindrical cushion device including a resilient cushion, the halving of the cushion being through a lengthwise central axis of a cylindrical cushion, the cushion having a flat rectangular surface, a semicylindrical surface, and two semicircular end surfaces. The second cushion device further includes at least two hook or loop fabric fastening means attached on surfaces of the second cushion device, each fastening means to detachably fasten to a complimentary hook or loop fabric fastening means on a surface of the first cushion device the fastening means include a first hook or loop fabric fastening means positioned on the rectangular surface and a second hook or loop fabric fastening means on the semicylindrical surface positioned intermediate the length of the semicylindrical surface and proximate a lengthwise edge. The support device further includes a third cushion device including a semicylindrical resilient cushion, the halving of the cushion being through a lengthwise central axis of a cylindrical cushion, the cushion having a flat rectangular surface, a semicylindrical surface, and two semicircular end surfaces. The third cushion device further includes a hook or loop fabric fastening means positioned on the semicylindrical surface positioned intermediate the length and proximate a lengthwise edge. The second and third hook or loop fabric fastening means on the first cushion device are positioned to fasten to the second hook or loop fabric fastening means on the second cushion device and to the hook or loop fabric fastening means on the third cushion device to form an "H" shaped support device from the three cushion devices fastened together with the rectangular surfaces of all three cushion devices facing a same direction. The first hook or loop fabric fastening means on the first and second cushion devices are positioned to fasten together to form a cylindrical shaped support device.

The invention is also a method of providing back support for a person sitting upright or slightly inclined against a vertical support back member. The method includes providing a first cushion device that includes a semicylindrical resilient cushion, the halving of the cushion being through a lengthwise central axis of a cylindrical cushion, the cushion having a flat rectangular surface, a semicylindrical surface, and two semicircular end surfaces. The first cushion device includes at least one hook or loop fabric fastening means attached on at least one surface of the first cushion device, each fastening means to detachably fasten to a complimentary hook or loop fabric fastening means on a surface of a second cushion device, the fastening means on the first cushion comprising a first hook or loop fabric fastening means on an end surface. The method further includes providing a second cushion device that includes a semicylindrical resilient cushion, the halving of the cushion being through a lengthwise central axis of a cylindrical cushion, the cushion having a flat rectangular surface, a semicylindrical surface, and two semicircular end surfaces. The second cushion device includes at least one hook or loop fabric fastening means attached on at least one surface of the second cushion device, each fastening means to detachably fasten to a complimentary hook or loop fabric fastening means on a surface of the first cushion device, the fastening means comprising a second hook or loop fabric fastening means on the semicylindrical surface positioned intermediate the length of the semicylindrical surface and proximate a lengthwise edge. The method further includes fastening the first hook or loop fabric fastening means on the first cushion to the second hook or loop fabric fastening means on the second cushion together to form a "T" shaped support device with the two rectangular surfaces facing in a same direction. The method further includes positioning the semicylindrical surface of the first cushion device in allignment lengthwise against the spine of the person, and the semicylindrical surface of the second cushion device horizontally against across the lumbar region of the back of the person, and allowing the person to lean back against the supporting cushion devices resting against the back support member. A preferred method of includes providing a third semicylindrical cushion device that includes a semicylindrical resilient cushion, the halving of the cushion being through a lengthwise central axis of a cylindrical cushion, the cushion having a flat rectangular surface, a semicylindrical surface, and two semicircular end surfaces. The third cushion device further includes at least one hook or loop fabric fastening means attached on at least one surface of the second cushion device, each fastening means to detachably fasten to a complimentary hook or loop fabric fastening means on a surface of the first cushion device, the fastening means comprising a third hook or loop fabric fastening means on the semicylindrical surface positioned intermediate the length of the semicylindrical surface and proximate a lengthwise edge, wherein the first cushion device further comprises a fourth hook or loop fabric fastening means positioned on the end surface opposite the first hook or loop fabric fastening means. The preferred method further includes fastening the fourth hook or loop fabric fastening means to the third hook or loop fabric fastening means on the third cushion device to form an "H" shaped support device from the three cushion devices fastened together with the rectangular surfaces of all three cushion devices facing a same direction, and positioning the semicylindrical surface of the third cushion device horizontally across against the cervical region of the back of the person.

BRIEF DESCRIPTIONS OF THE DRAWINGS

DESCRIPTION OF PREFERRED EMBODIMENTS

The phrase "hook or loop fabric fastening means", or "device" has been used throughout the specification and in the claims. This phrase is intended to include all fabric attachment devices which employ a multitude of tiny hooks extending outwardly from a strip of fabric and a second complimentary strip fabric employing a multitude of tiny loops, the loops and hook being of a size and configuration that when pressed together form a temporary attachment to act as a fastener. While any of such fastening devices may be utilized in the present invention, the most well known of these devices is the VELCRO fabric fastening device. Throughout the balance of this specification, the term "Velcro" is intended to include any suitable hook or loop fabric fastening device.

Figure 1:
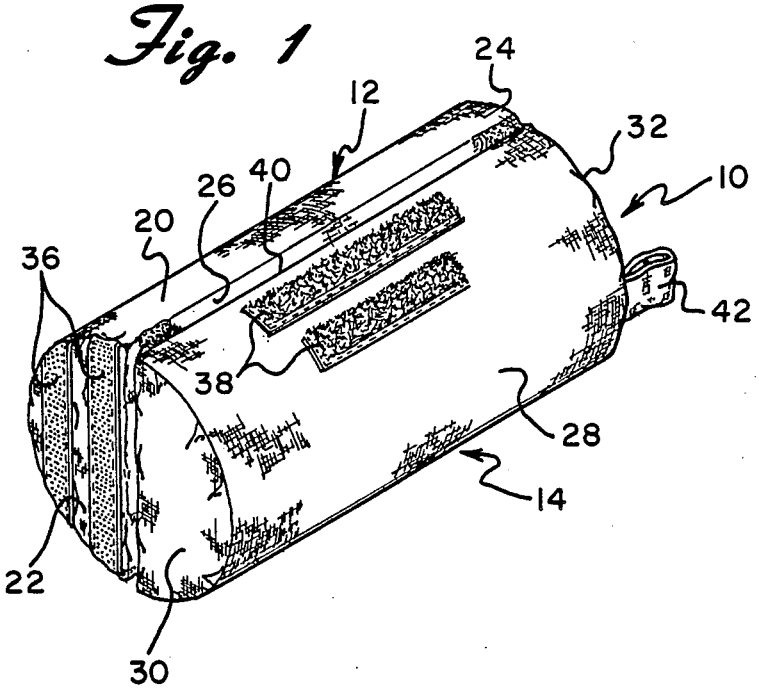
FIG. 1 is a perspective view of a total back support cushion device of the present invention with two cushions attached together to form a single large support cushion.

Support device 10 is illustrated in FIG. 1 including two semi-cylindrical resilient cushion devices 12 and 14 attached together to form a single cylindrical support cushion. In this configuration, the device is in a standard shape of a cylindrical support cushion typically used for lumbar supports or even cervical support. The term "semi-cylindrical" is intended to mean the half of a cylinder obtained when it is cut in half by a plane cutting through a central axis extending lengthwise through the center of the cylinder, the results of which are illustrated in FIG. 1. Each cushion device, for example 12, has four surfaces, namely semi-cylindrical surface 20, semi-circular end surface 22, semi-circular end surface 24 (hidden in this view) and rectangular surface 26 (mostly hidden in this view). Likewise cushion device 14 has the same four surfaces, semi-cylindrical surface 28, semi-circular end surface 30, semi-circular end surface 32 (hidden in this view) and rectangular surface 34 (hidden in this view). Two strips of hook Velcro fastener strips 36 are sewn or adhesively attached to end surface 22 of cushion device 12. Loop Velcro fastener strips 38 are attached to surface 28 of cushion device 14. Strips 38 are sewn or adhesively attached lengthwise on surface 28 intermediate between ends 30 and 32, and proximate lengthwise edge 40 which is a juncture between surface 28 and surface 34 (shown in FIG. 4). Fabric attachment loop 42 is sewn to cushion device 14 extending from end 32.

Figure 2:
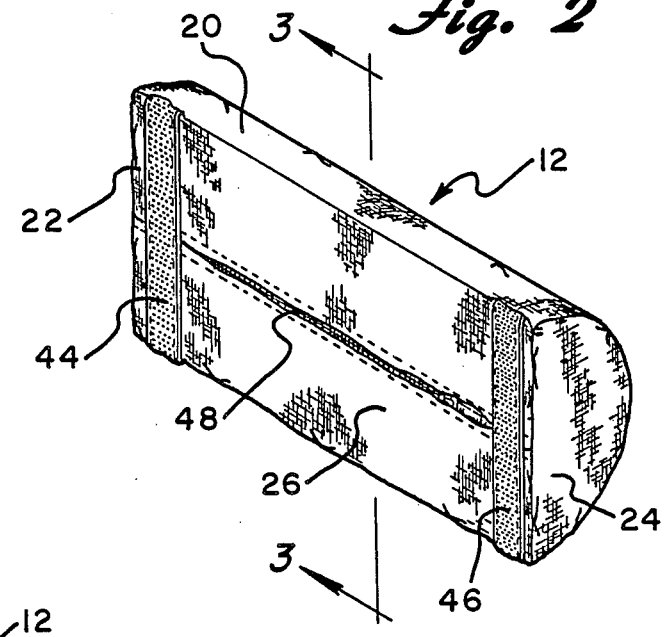
FIG. 2 is a perspective view of a single support cushion of the present invention.

In FIG. 2, cushion device 12 is illustrated turned around so that surfaces 24 and 26 may be totally viewed. This configuration of the invention has semi-circular end surface 24 with no Velcro attachments attached to it. In other configurations of the invention illustrated later, a Velcro attachment fastener will be attached on this end as well as the other end of a cushion device. Hook Velcro strips 44 and 46 are attached to rectangular surface 26 proximate ends 22 and 24, respectively. Velcro strips 44 and 46 are both attached longitudinally across the short ends of the rectangular surface 26. Zipper closure 48 extends along and closes a slit opening lengthwise down the center a major length of rectangular surface 26. The position of zipper 48 is close to the position of the central axis of the cylindrical shape described in FIG. 1.

Figure 3:
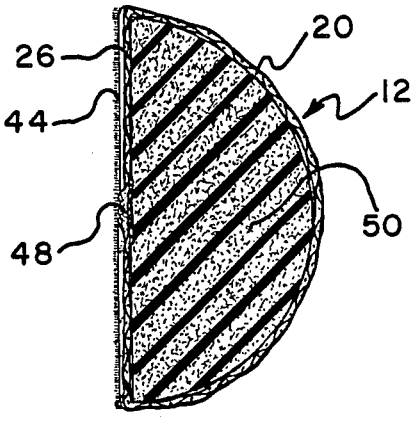
FIG. 3 is a cross-sectional view taken along lines 3—3 along FIG. 2.

In FIG. 3, the cross-sectional view shows resilient polymeric foam, such as polyurethane foam, in semi-cylindrical shape 50 encased in a cloth covering which includes in this view semi-cylindrical surface 20 and rectangular surface 26 sewn together with end surfaces 22 and 24 to form the cloth covering closed by zipper 48.

Figure 4:
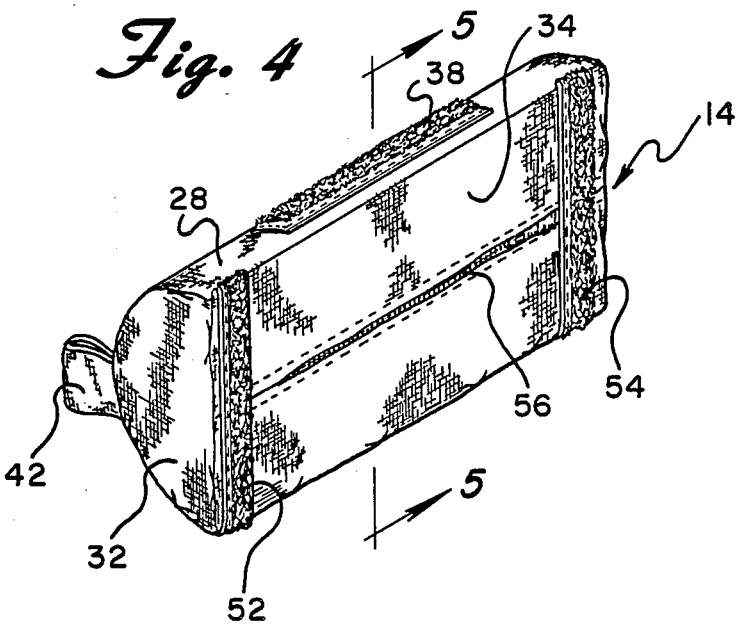
FIG. 4 is a perspective view of a second support cushion of the present invention.
Figure 5:
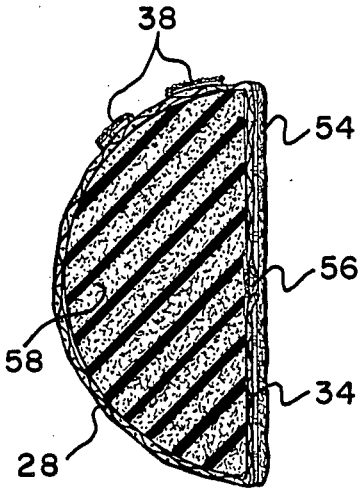
FIG. 5 is a vertical cross-sectional view taken along lines 5—5 of FIG. 4.

In FIG. 4 and FIG. 5, cushion device 14 is illustrated. Device 14 viewed from the opposite side so that rectangular surface 34 is now fully visible with loop Velcro strips 52 and 54 attached laterally along the short ends of surface 34 positioned to mate with and fasten to hook Velcro strips 44 and 46 on rectangular surface 26 of cushion device 12 to form the cylindrical support device illustrated in FIG. 1. Zipper closure 56 extends a major distance centrally lengthwise along surface 34 to allow removal of semi-cylindrical shaped form core 58 for cleaning the covering which includes surfaces 34, 30, 32, and 28. Cushion devices 12 and 14 are constructed to fasten together to form an inverted "T" shape by fastening together hook Velcro fastener strips 36 with loop Velcro fastener strips 38. Foam core 58 in chosen to be firmer than foam core 50 to provide the preferred additional support to the lumber region of the back. Similarly, in FIG. 6, cushion device 16 is fastened at one end with hook Velcro strips to loop Velcro strips 38 on cushion device 14. Cushion device 16 is identical to cushion device 12 except that hook Velcro strips 64 are attached on semi-circular end 62 as well as on the hidden end. Thus, Velcro strips are attached on both ends of device 16, while Velcro strips are attached on only one end of cushion device 12. Cushion device 16 has hook Velcro strips on both ends providing versatility which will be illustrated below. In the configuration illustrated in FIG. 6, cushion device 14 is positioned against the lumbar region of the back with semi-cylindrical surface 60 extending up the spine to support the thoracic region. As illustrated here, cushions are about 15 inches long, however, in order to accommodate varying lengths of the spine, the cushions are provided smaller, about 10 to 12 inches long, and longer, about 18 inches long. Further, in order to easily identify the firmer foam core recommended for lumbar support, the covering may be color coded for easy identification.

Figure 6:
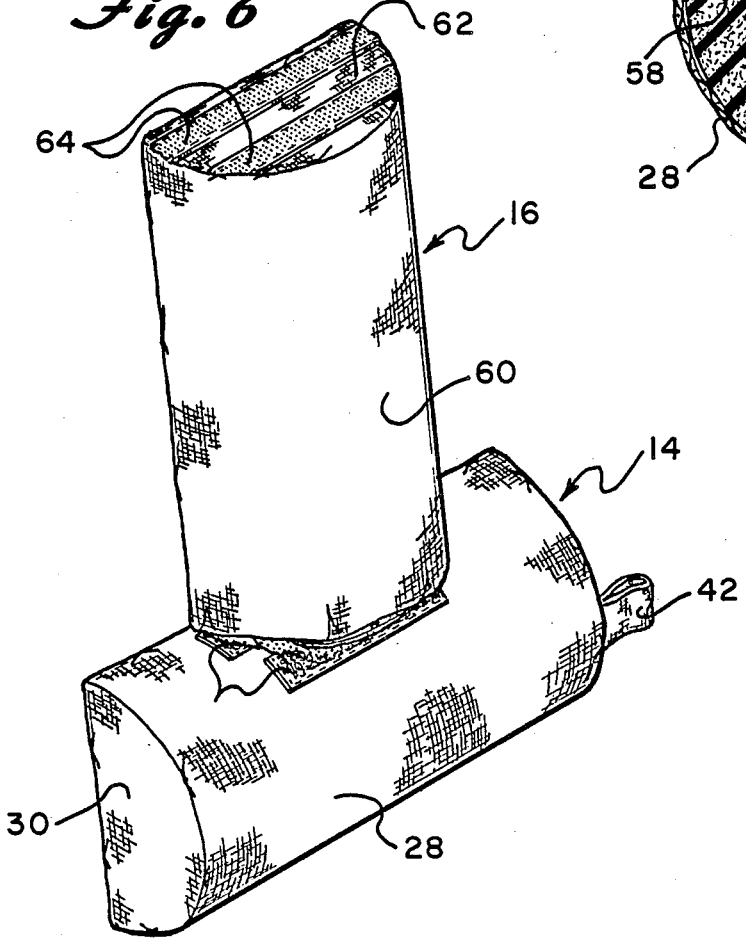
FIG. 6 is a perspective view of a total back support cushion device of the present invention detached as illustrated in FIG. 1 and reattached in an inverted "T" configuration.
Figure 7:
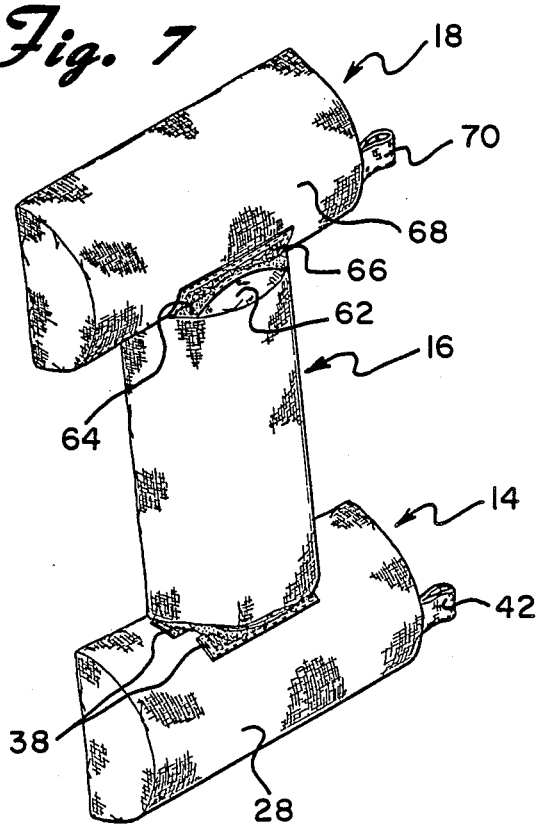
FIG. 7 is a total back support cushion device of the present invention wherein three cushion devices are attached in a side lying "H" configuration.
Figure 8:
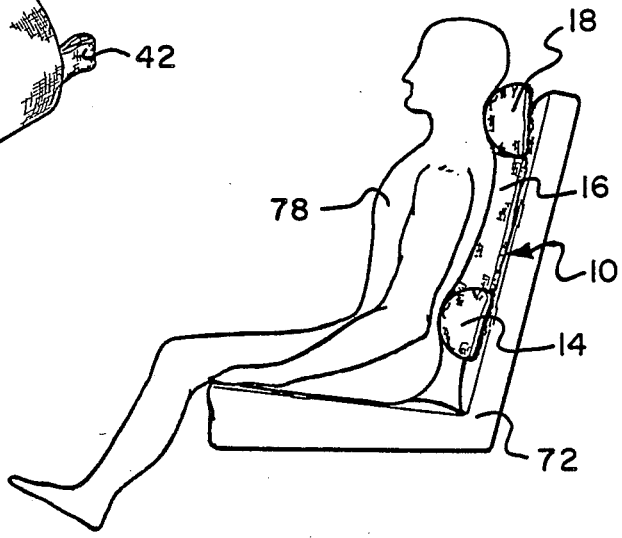
FIG. 8 is a diagram illustrating the use of the total back support cushion device illustrated in FIG. 7 on a person sitting generally upright.
Figure 9:
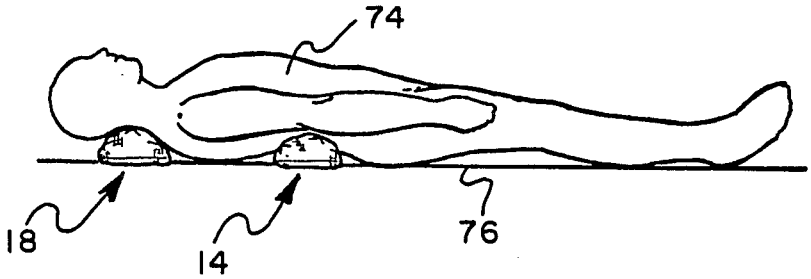
FIG. 9 is a diagram illustrating the use of the individual support cushions of the present invention under a person lying supine.

In FIG. 7, a side lying "H" shaped back support back device is illustrated fastening a third cushion device 18 positioned in a horizontal position on top surface of cushioning device 16 as illustrated in FIG. 6. The term "side lying" is intended to describe the positioning of the "H" shape lying on one of its upright sides. Cushion device 18 is equipped with loop Velcro strips 66 positioned lengthwise on semi-cylindrical surface 68 proximate a lengthwise edge and positioned to attach to hook Velcro strips 64 on end surface 62 of cushion device 16. Cloth loop 70 extends from the end of cushion device 18 in the same fashion as cloth loop 42. Cloth loop 42 is used as a carrying handle for device 10. It is preferred to provide lengthwise slits through the covering of either cushion device 12 or cushion device 16 along the two lengthwise edges joining the rectangular surface and the semicylindrical surface. The slits being positioned to allow a strap to be feed through the slits to hold the support device to a chair back. The use of the device illustrated in FIG. 7 is shown in FIG. 8, where person 78 is sitting in chair 72 with support device 10 supporting the cervical, thoracic and lumbar regions of the back. The individual cushion devices may be utilized as illustrated in FIG. 9 where person 74 is supine prone on surface 76 with cervical support provided by cushion device 18, although cushion devices 12 and 16 would perform in a like fashion. The lumbar region of the back is supported by cushion device 14. It should be noted that the configuration and position of the Velcro fastening devices places all of the hook type Velcro strips in positions where they will not come in contact with the skin of the person using the support device. Since the loop type Velcro fastening strips are relatively soft, and not abrasive to the skin, that type of Velcro is placed on the semi-cylindrical surfaces where the person might come in contact with the strips. On the other hand, the hook type Velcro strips tend to be more abrasive, and are positioned on the end surfaces of cushion devices 12 or 16, the hook type Velcro strips are placed on the rectangular surfaces of those cushions so all of the more abrasive Velcro fastening strips are on the same cushion. However, each of the cushions may be used individually for support of a particular region of the back.

While this invention has been described with reference to the specific embodiments disclosed herein, it is not confined to the details set forth and the patent is intended to include modifications and changes which may come within and extend from the following claims.

I claim:

1. A back support device comprising at least two cushion devices, each cushion device comprising:

(a) a semicylindrical resilient cushion, the halving being through a lengthwise central axis of a cylinder, the cushion comprising a flat rectangular surface, a semicylindrical surface, and two semicircular end surfaces, and (b) at least two hook or loop fabric fastening means attached on surfaces of the cushion device, each fastening means to detachably fasten to a complimentary hook or loop fabric fastening means on a surface of another cushion device, wherein one of said cushion devices is a first cushion comprising a first hook or loop fabric fastening means positioned on the rectangular surface and a second hook or loop fabric fastening means on an end surface, wherein a second of said cushion devices is a second cushion comprising a first hook or loop fabric fastening means positioned on the rectangular surface and a second hook or loop fabric fastening means on the semicylindrical surface positioned intermediate the length of the semicylindrical surface and proximate a lengthwise edge, wherein the first hook or loop fabric fastening means on the first and second cushion devices are positioned to fasten together to form a cylindrical shaped support device, and wherein the second hook or loop fabric fastening means on the first and second cushions are positioned to fasten together to form a "T" shaped support device with the two rectangular surfaces facing in a same direction.

2. The support device of claim 1 wherein a third of said cushion devices is a third cushion comprising a hook or loop fabric fastening means positioned on the semicylindrical surface positioned intermediate the length and proximate a lengthwise edge, and wherein the first cushion device further comprises a third hook or loop fabric fastening means positioned on the end surface opposite the second hook or loop fabric fastening means, the third hook or loop fabric fastening means being positioned to fasten to the hook or loop fabric fastening means on the third cushion device to form an "H" shaped support device from the three cushion devices fastened together with the rectangular surfaces of all three cushion devices facing a same direction.

3. The support device of claim 1 wherein the first hook or loop fabric fastening means are positioned transverse along both ends of the both rectangular surfaces.

4. The support device of claim 1 wherein the second hook or loop fabric fastening means on the first cushion device comprises a multiplicity of fiber hooks.

5. The support device of claim 1 wherein both hook or loop fabric fastening means on the first cushion device comprise a multiplicity of fiber hooks.

6. The support device of claim 1 wherein the second hook or loop fabric fastening means on the second cushion device comprises a multiplicity of fiber loops.

7. The support device of claim 1 wherein both hook or loop fabric fastening means on the second cushion device comprise a multiplicity of fiber loops.

8. The support device of claim 2 wherein the hook or loop fabric fastening means on the third cushion device comprises a multiplicity of fiber loops.

9. The support device of claim 1 wherein each cushion device comprises a resilient polymeric foam core and a cloth covering.

10. The support device of claim 9 wherein the second cushion device comprises a foam core firmer than that of the first cushion device.

11. The support device of claim 9 wherein each cushion device comprises a zipper closure of the cloth covering positioned on the rectangular surface, the zipper closure being of sufficient size to allow insertion and removal of the foam core.

12. A back support device comprising:

(a) a first semicylindrical cushion device comprising:

(i) a resilient cushion, the halving of the cushion being through a lengthwise central axis of a cylindrical cushion, the cushion having a flat rectangular surface, a semicylindrical surface, and two semicircular end surfaces, and (ii) at least two hook or loop fabric fastening means attached on surfaces of the first cushion device, each fastening means to detachably fasten to a complimentary hook or loop fabric fastening means on a surface of a second cushion device, the fastening means comprising a first hook or loop fabric fastening means positioned on the rectangular surface and a second hook or loop fabric fastening means on an end surface, and (b) a second semicylindrical cushion device comprising:

(i) a resilient cushion, the halving of the cushion being through a lengthwise central axis of a cylindrical cushion, the cushion having a flat rectangular surface, a semicylindrical surface, and two semicircular end surfaces, and (ii) at least two hook or loop fabric fastening means attached on surfaces of the second cushion device, each fastening means to detachably fasten to a complimentary hook or loop fabric fastening means on a surface of the first cushion device, the fastening means comprising a first hook or loop fabric fastening means positioned on the rectangular surface and a second hook or loop fabric fastening means on the semicylindrical surface positioned intermediate the length of the semicylindrical surface and proximate a lengthwise edge, wherein the first hook or loop fabric fastening means on the first and second cushion devices are positioned to fasten together to form a cylindrical shaped support device, and wherein the second hook or loop fabric fastening means on the first and second cushions are positioned to fasten together to form a "T" shaped support device with the two rectangular surfaces facing in a same direction.

13. The support device of claim 12 further comprising a third cushion device comprising:

(a) a resilient semicylindrical cushion, the halving of the cushion being through a lengthwise central axis of a cylindrical cushion, the cushion having a flat rectangular surface, a semicylindrical surface, and two semicircular end surfaces, and (b) a hook or loop fabric fastening means positioned on the semicylindrical surface positioned intermediate the length and proximate a lengthwise edge, and wherein the first cushion device further comprises a third hook or loop fabric fastening means positioned on the end surface opposite the second hook or loop fabric fastening means, the third hook or loop fabric fastening means being positioned to fasten to the hook or loop fabric fastening means on the third cushion device to form an "H" shaped support device from the three cushion devices fastened together with the rectangular surfaces of all three cushion device facing a same direction.

14. The support device of claim 12 wherein both hook or loop fabric fastening means on the second cushion device comprise a multiplicity of fiber loops.

15. The support device of claim 12 wherein each cushion device comprises a resilient polymeric foam core and a cloth covering.

16. The support device of claim 12 wherein the second cushion device comprises a foam core firmer than that of the first cushion device.

17. A back support device comprising:

(a) a first cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) at least three hook or loop fabric fastening means attached on surfaces of the first cushion device, each fastening means to detachably fasten to a complimentary hook or loop fabric fastening means on a surface of a second cushion device, the fastening means comprising a first hook or loop fabric fastening means positioned on the rectangular surface and a second and a third hook or loop fabric fastening means on each end surface, (b) a second cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) at least two hook or loop fabric fastening means attached on surfaces of the second cushion device, each fastening means to detachably fasten to a complimentary hook or loop fabric fastening means on a surface of the first cushion device, the fastening means comprising a first hook or loop fabric fastening means positioned on the rectangular surface and a second hook or loop fabric fastening means on the semicylindrical surface positioned intermediate the length of the semicylindrical surface and proximate a lengthwise edge, and (c) a third cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) a hook or loop fabric fastening means positioned on the semicylindrical surface positioned intermediate the length and proximate a lengthwise edge, wherein the second and third hook or loop fabric fastening means on the first cushion device are positioned to fasten to the second hook or loop fabric fastening means on the second cushion device and to the hook or loop fabric fastening means on the third cushion device to form an "H" shaped support device from the three cushion devices fastened together with the rectangular surfaces of all three cushion devices facing a same direction, and wherein the first hook or loop fabric fastening means on the first and second cushion devices are positioned to fasten together to form a cylindrical shaped support device.

18. The support device of claim 17 wherein both hook or loop fabric fastening means on the second cushion device comprise a multiplicity of fiber loops.

19. The support device of claim 17 wherein each cushion device comprises a resilient polymeric foam core and a cloth covering.

20. The support device of claim 17 wherein the second cushion device comprises a foam core firmer than that of the first cushion device.

21. A method of providing back support for a person sitting upright or slightly inclined against a vertical support back member, the method comprising:

(a) providing a first cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) at least one hook or loop fabric fastening means attached on at least one surface of the first cushion device, each fastening means to detachably fasten to a complimentary hook or loop fabric fastening means on a surface of a second cushion device, the fastening means on the first cushion comprising a first hook or loop fabric fastening means on an end surface, (b) providing a second cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) at least one hook or loop fabric fastening means attached on at least one surface of the second cushion device, each fastening means to detachably fasten to a complimentary hook or loop fabric fastening means on a surface of the first cushion device, the fastening means comprising a second hook or loop fabric fastening means on the semicylindrical surface positioned intermediate the length of the semicylindrical surface and proximate a lengthwise edge, (c) fastening the first hook or loop fabric fastening means on the first cushion to the second hook or loop fabric fastening means on the second cushion together to form a "T" shaped support device with the two rectangular surfaces facing in a same direction, (d) positioning the semicylindrical surface of the first cushion device in allignment lengthwise against the spine of the person, and the semicylindrical surface of the second cushion device horizontally against across the lumar region of the back of the person, and (e) allowing the person to lean back against the supporting cushion devices resting against the back support member.

22. The method of claim 21 further comprising:

(a) providing a third semicylindrical cushion device comprising:

(i) a semicylindrical resilient cushion, the halving of the cushion being through a lengthwise central axis of a cylindrical cushion, the cushion having a flat rectangular surface, a semicylindrical surface, and two semicircular end surfaces, and (ii) at least one hook or loop fabric fastening means attached on at least one surface of the second cushion device, each fastening means to detachably fasten to a complimentary hook or loop fabric fastening means on a surface of the first cushion device, the fastening means comprising a third hook or loop fabric fastening means on the semicylindrical surface positioned intermediate the length of the semicylindrical surface and proximate a lengthwise edge, wherein the first cushion device further comprises a fourth hook or loop fabric fastening means positioned on the end surface opposite the first hook or loop fabric fastening means, (b) fastening the fourth hook or loop fabric fastening means to the third hook or loop fabric fastening means on the third cushion device to from an "H" shaped support device from the three cushion devices fastened together with the rectangular surfaces of all three cushion devices facing a same direction, and (c) positioning the semicylindrical surface of the third cushion device horizontally across against the cervical region of the back of the person.

* * * * *